US006752904B2

(12) United States Patent
Bryant et al.

(10) Patent No.: US 6,752,904 B2
(45) Date of Patent: Jun. 22, 2004

(54) PROCESS FOR REMOVAL OF LIGNIN FROM LIGNOCELLULOSIC MATERIAL

(75) Inventors: Patrick S. Bryant, Woodstock, GA (US); John C. Sokol, Kennesaw, GA (US); Dwane S. Hutto, Kennesaw, GA (US)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 09/798,843

(22) Filed: Mar. 2, 2001

(65) Prior Publication Data

US 2002/0088569 A1 Jul. 11, 2002

Related U.S. Application Data

(63) Continuation of application No. 09/501,384, filed on Feb. 9, 2000, now abandoned.

(51) Int. Cl.[7] ..... D21C 9/14

(52) U.S. Cl. ..... 162/67; 162/63; 162/66; 162/27; 162/28

(58) Field of Search ..... 162/19, 20, 27, 162/28, 63, 64, 65, 66, 67

(56) References Cited

U.S. PATENT DOCUMENTS

| | | | | | |
|---|---|---|---|---|---|
| 3,591,451 | A | | 7/1971 | Wilder | 162/67 |
| 3,919,041 | A | | 11/1975 | Wilder | 162/25 |
| RE28,777 | E | * | 4/1976 | Wilder | 162/67 |
| 4,152,197 | A | * | 5/1979 | Lindahl et al. | 162/19 |
| 4,622,100 | A | * | 11/1986 | Godsay et al. | 162/65 |
| 4,750,973 | A | * | 6/1988 | Samuelson et al. | 162/65 |
| 4,770,868 | A | | 9/1988 | Norell | 423/479 |
| 4,869,783 | A | | 9/1989 | Prusas et al. | 162/18 |
| 5,002,635 | A | * | 3/1991 | Gentile, Jr. et al. | 162/76 |
| 5,091,166 | A | | 2/1992 | Engstrom et al. | 423/478 |
| 5,091,197 | A | | 2/1992 | Ferro et al. | 426/80 |
| 5,380,517 | A | | 1/1995 | Sokol | 423/478 |
| 5,433,825 | A | * | 7/1995 | Minor et al. | 162/86 |
| 5,474,654 | A | | 12/1995 | Mendiratta et al. | 162/53 |
| 6,235,153 | B1 | * | 5/2001 | Uchida et al. | 162/65 |

FOREIGN PATENT DOCUMENTS

| | | | | |
|---|---|---|---|---|
| DE | 1 049 220 | | 1/1959 | |
| GB | 567774 | | 3/1945 | |
| JP | 7625615 | * | 3/1977 | |
| JP | 52-110901 | | 9/1977 | D21C/3/00 |
| JP | 53-25044 | | 3/1978 | E04H/7/00 |
| SE | 454 185 B | | 4/1988 | D21B/1/02 |
| WO | 89 08165 | | 9/1989 | D21C/1/04 |
| WO | WO 91/19040 | | 12/1991 | D21B/1/02 |

OTHER PUBLICATIONS

Written Opinion of International Application No. PCT/SE01/00257, dated Apr. 12, 2002.

*Kirk–Othmer, Encyclopedia of Chemical Technology*, vol. 20, 4th Ed., p. 535.

*Rydholm, Pulping Processes, Interscience Publisher*, p. 284.

*Ullman's Encyclopedia of Industrial Chemistry*, vol. A18, 5th Ed., 1991, pp. 568–569.

*Derwent No. 1974–44761V* [24] *Abstract of Japan Patent 49020241B*, May 23, 1974.

Derwent No. 1989–059880 [08] Abstract of Soviet Union Patent 1416576A, Aug. 15, 1988.

European Search Report EP 00 85 0037.

Derwent Abstract 001855900 abstracting JP 52–110901.

Derwent Abstract 001855900 abstracting JP 53–25044.

* cited by examiner

*Primary Examiner*—Dean T. Nguyen
(74) *Attorney, Agent, or Firm*—Lainie E. Parker; Michelle J. Burke

(57) ABSTRACT

The present invention relates to a process for the removal of lignin from lignocellulose containing material comprising treating the lignocellulose containing material prior to a high-yield pulping process with a delignifying gas comprising gaseous compounds comprising at least one oxygen atom such as chlorine dioxide containing gas.

10 Claims, No Drawings

PROCESS FOR REMOVAL OF LIGNIN FROM LIGNOCELLULOSIC MATERIAL

This application is a continuation of application Ser. No. 09/501,384, filed Feb. 9, 2000 now abandoned.

FIELD OF THE INVENTION

The present invention relates to a process for the removal of lignin from lignocellulose containing material comprising treating the lignocellulose containing material prior to a high-yield pulping process with a delignifying gas comprising gaseous compounds comprising at least one oxygen atom.

BACKGROUND OF THE INVENTION

In high-yield processes, or mechanical pulping processes as they also are referred to, the objective is to disrupt the structure of the lignocellulosic containing material in fragments of variable dimensions by the use of mechanical treatment optionally in the presence of chemicals.

High-yield pulps are produced by grinding or refining of the lignocellulose containing material and thereby essentially all of the fibres constituents are retained in the pulp.

High-yield pulping processes encompasses grinding, screening and refining processes. In the grinding process, washed logs are forced against a rotating grinding disk to tear the lignocellulose containing material into small pieces which are then further processed by screening or refining to produce mechanical pulp. In the refining process, screened washed chips pass between rotating disks or a rotating and stationary disk to shred the lignocellulose containing material into pulp. The resultant pulp may then be further refined, screened and cleaned to produce the desired mechanical pulp.

One aspect of high-yield pulping is to rip or shred the lignocellulose containing material into fibres which consumes energy. This energy is measured as the power required to rotate the grindstone or the refiner disk(s).

A significant portion of the total energy used in high-yield pulping process is required to break or soften the lignin bonded to the cellulose and hemicellulose fibres. Weakening or breaking down the lignin structure prior to the grinding or refining process results in significant reductions in the power requirement to produce the finished high-yield (mechanical) pulp.

Energy, usually measured in terms of electrical power, is a major component in the cost of producing high-yields pulps. Thus, the pulp production cost increases directly with the cost of energy.

Therefore, one advantage of the present invention is to provide a pretreatment process that softens or breaks the lignin contained within the lignocellulose containing material resulting in a substantial reduction in the energy required to produce high yield pulp.

U.S. Pat. No. 4,172,006 refers to the pretreatment of wood chips with oxygen prior to adding a cooking liquor.

U.S. Pat. No. 4,750,973 relates to a process for reducing carbohydrate losses in sulphate pulping of wood using sodium hydroxides and sodium sulfide, wherein the wood is pretreated in presence of water with oxygen gas and nitrogen oxides.

GB 567774 discloses a process for the treatment of cellulosic raw material where wood chips are contacted with a aqueous solution of a wetting agent prior to subjecting the chips to a solution containing sodium chlorite thereby using sufficient acid to insure the liberation of chlorine dioxide.

WO 8908165 refers to a method for the pretreatment of wood chips with sulphur dioxide gas prior to alkaline deligification operations.

DE 1049220 discloses a method comprising subjecting wood chips to carbon acid before sulfite cooking.

JP 49020241 refers to a pulping process comprising the steps of reacting chlorine dioxide or a mixture consisting of chlorine dioxide and chlorine with wood chips in the presence of water soluble cellulose derivatives and thereafter removing inter alia the oxidised lignin by extraction.

U.S. Pat. No. 5,474,654 refers to a delignification process where chlorine dioxide gas is used on pulp obtained from pulping processes such as chemical kraft, sulfide or mechanical processes.

Common to all prior art documents cited above is that the pretreatment is carried out before a chemical pulping process.

U.S. Pat. Nos. 3,591,451 and 3,919,041 disclose the use of gaseous chlorine dioxide subsequent a pretreatment step which may be either mechanical, chemical or a combination thereof.

SUMMARY OF THE INVENTION

In accordance with the present invention it has surprisingly been found that a substantial reduction in the energy required to produce high yield pulp can be obtained by providing a process according to the claims. More specifically, the invention relates to a process for the removal of lignin from lignocellulose containing material comprising treating the lignocellulose containing material prior to a high-yield pulping process with a delignifying gas, wherein the gas comprises gaseous compounds comprising at least one oxygen atom.

DETAILED DESCRIPTION OF THE INVENTION

Suitable lignocellulose containing material used in the present invention can be any lignocellulose containing material derived from natural sources such as softwood, hardwood, gum, straw, bagasse and/or bamboo. The physical state of the lignocellulose containing material is not critical, however, a physical state providing a large surface area is preferred that maximises penetration of the delignifying gas and optionally processing chemicals. Suitably, the lignocellulose containing material is in the form of chips with a size which is governed by the process equipment and process parameters.

Further advantages of the present invention are apparent from the specification.

The lignocellulose containing material is suitably treated according to any method known to the skilled artisan which renders the diffusion of the delignifying gas within the fibre source to the lignin more effective such as steaming and/or evacuation.

According to the present invention the lignocellulosic material is treated with a delignifying gas comprising gaseous compounds comprising at least one oxygen atom. Suitably, the delignifying gas comprising chlorine dioxide, nitrogen oxides, carbon dioxide or sulphur dioxide or mixtures thereof. Nitrogen oxides include nitrogen monoxide, nitrogen dioxide, polymeric oxides and double molecules thereof, e.g. $N_2O_4$ or $N_2O_3$.

The delignifying gas mixture is suitably a non-liquid containing gas.

According to one preferred embodiment the delignifying gas comprises chlorine dioxide. The chlorine dioxide containing gas may contain other gases such as nitrogen, oxygen, air or steam or mixtures thereof. The chlorine dioxide containing gas may also contain small amounts of chlorine, however, the gas is suitably substantially free from chlorine, preferably having less than 10% by volume, more preferably less than 1% by volume of chlorine.

The use of a delignifying gas such as a gas comprising chlorine dioxide overcomes several unsolved problems. Treatment of the lignocellulosic containing material with solutions containing for example chlorine dioxide is limited by the rate of chlorine dioxide diffusion through the solution to the fibre source followed by the diffusion of the chlorine dioxide within the fibre source to the lignin. The result is a slow delignification process that works primarily on the fibre source surface and an aqueous effluent stream containing chlorine dioxide, dissolved fibre components and chlorides, which is difficult to treat in an environmentally correct manner.

It has been found that a gas comprising chlorine dioxide does not have the diffusion barriers that limit the process when a solution is used. The gas passes rapidly and uniformly into the fibre source resulting in even delignification throughout the material. Furthermore, there are no aqueous effluent streams.

Preferably, the gas comprising chlorine dioxide is applied on lignocellulose containing material free from any surrounding aqueous solution. Preferably, the moisture content of the lignocellulose containing material is from about 30 weight % up to about 60 weight % based on oven dry material, more preferably from about 40 up to about 50 weight %.

The chlorine dioxide containing gas employed in the present invention is suitably produced using a chlorine dioxide generation process as described in the U.S. Pat. Nos. 4,770,868, 5,091,197 and 5,380,517, which all are incorporated by reference.

The concentration of chlorine dioxide in the gas is not critical for the invention. Thus, the lignocellulose containing material may be treated with substantially pure chlorine dioxide gas. The upper limit of the amount of chlorine dioxide, i.e. chlorine dioxide comprised in the gas mixture, is purely set by safety considerations. Suitable concentrations of chlorine dioxide comprised in the gas mixture are from about 0.05 up to about 100% by volume, more preferably from about 0.05 up to about 50% by volume and most preferably from about 1 up to about 20% by volume.

The gas comprising chlorine dioxide is generally applied in amounts which renders a reduction in the energy required for the production of pulp compared to a process where the lignocellulose containing material has not been subjected to chlorine dioxide prior to said high-yield process. Usually, increased applied amount of chlorine dioxide comprised in the gas (mixture) increases the degree of delignification. The charge of chlorine dioxide is from about 0.5 kg/tonne up to about 300 kg active $Cl_2$ per tonne of oven dry material, more preferably from about 2 kg up to about 100 kg active $Cl_2$ per tonne oven dry material and most preferably from about 30 kg/tonne up to about 50 kg active $Cl_2$ per tonne oven dry material.

The present invention may be performed at any location prior to high-yield pulping processes, i.e. mechanical pulping processes.

According to a preferred embodiment the treatment with the gas comprising gaseous compounds comprising at least one oxygen atom is carried out prior to a refining process, suitably prior to a first refining process.

The lignocellulose containing material may be treated with the delignifying gas in any type of equipment. For practical reasons the equipment should be gas tight. The treatment with the gas comprising chlorine dioxide may also be carried out in the same equipment (vessel) as is used for the subsequent pulping process.

Suitably, the treatment is carried out in an equipment such as a vessel which is essentially free from an aqueous solution, i.e. the treatment is carried out in the absence of aqueous solutions. By essentially free from an aqueous solution is meant that a minor amount aqueous solution can be present during the treatment with a gas comprising chlorine dioxide as long as the removal efficiency of lignin is not significantly impaired, i.e. as long as the overall diffusion (diffusion of the gas in respect of the totality of material treated) of the gas containing chlorine dioxide to the lignocellulose containing material is not significantly impaired or as long as a reduction in the energy required for the production of high-yield pulp is obtained compared to a process where the lignocellulose containing material has not been subjected to chlorine dioxide prior to said high-yield process.

The delignifying gas such as a gas comprising chlorine dioxide is suitably admixed with the lignocellulose containing material in an equipment which is at any suitable pressure including atmospheric, subatmospheric or superatmospheric pressures. Suitably, the treatment is carried out at a pressure ranging from about 10 kPa up to about 500 kPa, preferably from about 50 kPa up to about 250 kPa. The most preferred pressure ranges from about 80 kPa up to about 120 kPa.

The temperature during the treatment according to the present invention is not critical and can be carried out at surprisingly low temperatures including ambient temperatures. The upper temperature level in the treatment is set by economical and safety considerations. Temperatures may range from about 10° C. up to about 400° C., suitably from about 15° C. up to 200° C., more preferably from 20° C. up to about 95° C. and most preferably from about 25° C. up to about 90° C. Suitable temperature ranges are also those obtained by combining any of the lower temperature level of above ranges with any of the higher temperature levels.

According to one preferred embodiment of the present invention the lignocellulose containing material is pretreated prior to being subjected to the gas comprising chlorine dioxide. The pretreatment may be accomplished in the same equipment used for the delignifying gas, yet, the pretreatment can also be performed in any suitable equipment located upstream the treatment with the delignifying gas. Suitably, the pretreatment includes various steaming and/or evacuation processes. The pretreatment is believed to open up the lattice structure of the lignocellulose containing material thereby improving the diffusion of the delignifying gas into the material.

High-yield or mechanical pulping processes are generally pulping processes where the yield typically is from about 70 up to about nearly 100% by weight based on total lignocellulose containing material. Commonly, high-yield pulping processes are referred to as stone groundwood (SGW), pressurised groundwood (PGW), refiner mechanical pulp (RMP) and modifications thereof, thermomechanical pulp (TMP), chemithermomechanical pulp (CTMP) or chemimechanical pulp (CMP). The basic principle in high-yield pulping processes is to disrupt the wood structure in fragments of variable dimensions by the use of mechanical treatments optionally in conjunction with chemicals such as sulphite. Usually a refiner is used, where wood ships are fed between two metal disks, of which at least one disc is rotating, and the wood fibres are separated by the action of grooves and bars located on the surface of the two disks. Obviously, energy usage is high in high-yield pulping processes, especially in TMP pulping processes.

Thus, one advantage with the present invention is that by treating lignocellulose containing material prior to high-yield pulping processes the input of energy in said pulping processes can be significantly reduced.

The process may be operated in either batch or continuous mode.

To further illustrate the invention the following examples are provided. All parts and percentages are by weight unless otherwise specified. Temperatures are in degrees Celsius.

EXAMPLE

In this example the total energy consumption for refining untreated wood chips and wood chips treated with chlorine dioxide containing gas prior to high yield pulping to specific Canadian Standard Freeness (CSF) levels was measured.

Douglas Fir wood chips obtained from a commercial pulp supplier were used. The samples were pulled at random from the chip supply and were then mixed and separated into samples 1 and 2. There was no special handling, separation or classification of the chips prior to the experiment. The chips of sample 1 were treated with the chlorine dioxide containing gas in a packed bed reactor with a gas containing approximately 3% to 5% chlorine dioxide on a volume basis. Approximately 20 grams of chlorine dioxide were used to treat 1 kg of wood chips. The resulting treated wood chips were then pre-steamed and mechanically refined to specific Canadian Standard Freeness levels using a Sprout-Bauer 12-1 CP pressurized laboratory refiner. The first stage refining involves size reduction from chips to matchstick material and was conducted at approximately 30% consistency. All subsequent refining stages were performed at 15% consistency. Chip pre-steaming was conducted for 3 to 5 minutes by direct injection of 206,8 kPa (30 psig) steam. In subsequent refining stages, the pulp was heated by steaming with low-pressure steam 13,8–20,7 kPa (2–3 psig) by direct injection to heat the wood to 100° C. The energy consumption at each CSF level was measured (table 1).

Wood chips from sample 2 which were not subjected to chlorine dioxide treatment were pre-steamed and refined to the same CSF levels using the same equipment and procedures as the wood of sample 1 to establish a base energy consumption for the refining process.

Table 1 shows the total energy requirement versus the CSF for wood chips not subjected to a chlorine dioxide containing gas (control) and wood chips treated with a chlorine dioxide containing gas as outlined above (treated).

TABLE 1

| | Total Energy kWatt-hour/metric tonne | | |
|---|---|---|---|
| CSF | Control | Treated | Delta % |
| 750 | 876 | 532 | 39 |
| 700 | 969 | 580 | 40 |
| 650 | 1069 | 632 | 41 |
| 600 | 1177 | 689 | 42 |

TABLE 1-continued

| | Total Energy kWatt-hour/metric tonne | | |
|---|---|---|---|
| CSF | Control | Treated | Delta % |
| 550 | 1294 | 750 | 42 |
| 500 | 1423 | 816 | 43 |
| 450 | 1565 | 890 | 43 |
| 400 | 1723 | 973 | 44 |
| 350 | 1903 | 1067 | 44 |
| 300 | 2111 | 1175 | 44 |
| 250 | 2357 | 1303 | 45 |
| 200 | 2657 | 1459 | 45 |
| 150 | 3045 | 1661 | 45 |
| 100 | 3591 | 1946 | 46 |
| 50 | 4525 | 2432 | 46 |

Table 1 clearly shows a significant reduction in the energy requirement when producing mechanical pulp using wood chips treated with chlorine dioxide containing gas. In the commercially relevant area, i.e. CSF between 50 and 150 ml, the energy requirement for the treated chips is approximately 45% lower than the untreated chips.

The invention is further illustrated by the following claims, which, however, do not limit the scope thereof.

What is claimed is:

1. A process for the removal of lignin from lignocellulose containing material comprising treating the lignocellulose containing material prior to a high-yield mechanical pulping process with a sufficient amount of delignifying gas comprising chlorine dioxide.

2. A process according to claim 1, wherein the charge of chlorine dioxide is from about 0.5 kg active $Cl_2$ per tonne oven dry lignocellulose containing material up to about 300 kg active $Cl_2$ per tonne oven dry lignocellulose containing material.

3. A process according to claim 2, wherein the charge of chlorine dioxide is from about 2 kg active $Cl_2$ per tonne oven dry lignocellulose containing material up to 100 kg active $Cl_2$ per tonne oven dry lignocellulose containing material.

4. A process according to claim 1, wherein the concentration of chlorine dioxide In the delignifying gas is from about 0.05 up to about 100% by volume.

5. A process according to claim 4, wherein the concentration of chlorine dioxide in the delignifying gas is from about 0.05 up to about 50% by volume.

6. A process according to claim 1, wherein the pressure during the treatment with the delignifying gas is from about 10 kPa up to about 500 kPa.

7. A process according to claim 1, wherein the temperature during the treatment is from about 10 up to about 400° C.

8. A process according to claim 1, wherein the lignocellulose containing material prior to the treatment with the delignifying gas is subjected to steaming and/or evacuation.

9. A process according to claim 1, wherein the treatment with the delignifying gas is operated in batch or continuous mode.

10. A process for the removal of lignin from lignocellulose containing material comprising treating the lignocellulose containing material prior to a high-yield mechanical pulping process with a sufficient amount of delignifying gas comprising chlorine dioxide, said treatment being carried out essentially free of any aqueous solutions.

* * * * *